US005703316A

United States Patent [19]

Madden, Jr.

[11] Patent Number: 5,703,316

[45] Date of Patent: Dec. 30, 1997

[54] TRUNK LID, BULLET RESISTANT APPARATUS

[76] Inventor: James R. Madden, Jr., 4410 W. Acoma Dr., Glendale, Ariz. 85306-4506

[21] Appl. No.: 786,223

[22] Filed: Jan. 21, 1997

[51] Int. Cl.[6] ..... F41H 5/06

[52] U.S. Cl. ..... 89/36.08; 89/36.02; 296/152

[58] Field of Search ..... 89/36.08, 36.07, 89/36.02; 296/76, 152; 109/49.5

[56] References Cited

U.S. PATENT DOCUMENTS

| | | | |
|---|---|---|---|
| 1,796,081 | 3/1931 | Bundy | 296/76 |
| 3,909,060 | 9/1975 | Katayama | 296/76 |
| 4,139,231 | 2/1979 | Lang et al. | 296/76 |
| 5,271,311 | 12/1993 | Madden, Jr. | 89/36.08 |
| 5,370,035 | 12/1994 | Madden, Jr. | 89/36.02 |
| 5,413,026 | 5/1995 | Madden, Jr. | 89/36.08 |
| 5,438,908 | 8/1995 | Madden, Jr. | 89/36.08 |
| 5,487,323 | 1/1996 | Madden, Jr. | 89/36.08 |

OTHER PUBLICATIONS

Simula, Remak, Oct. 18, 1993, two pages.

*Primary Examiner*—Stephen M. Johnson
*Attorney, Agent, or Firm*—H. Gordon Shields

[57] ABSTRACT

Bullet resistant curtain apparatus protects the rear of a vehicle. The curtain apparatus includes a curtain secured to the trunk lid of the vehicle and is deployed when the trunk lid is opened. The curtain apparatus includes a flexible curtain made of a plurality of bullet resistant cloth layers. The curtain folds as the trunk closes. A second embodiment includes a movable base with posts to which the curtain may be secured to comprise a portable shield. The base includes wheels for moving the portable shield. The curtain is removably secured to the trunk lid and is thus easily converted into the movable, portable shield.

15 Claims, 3 Drawing Sheets

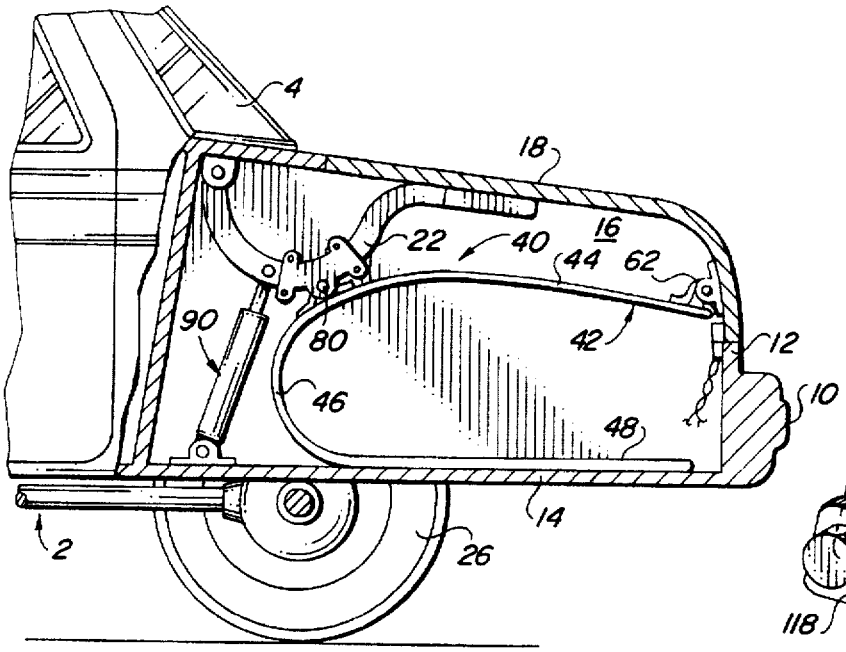
FIG. 4A
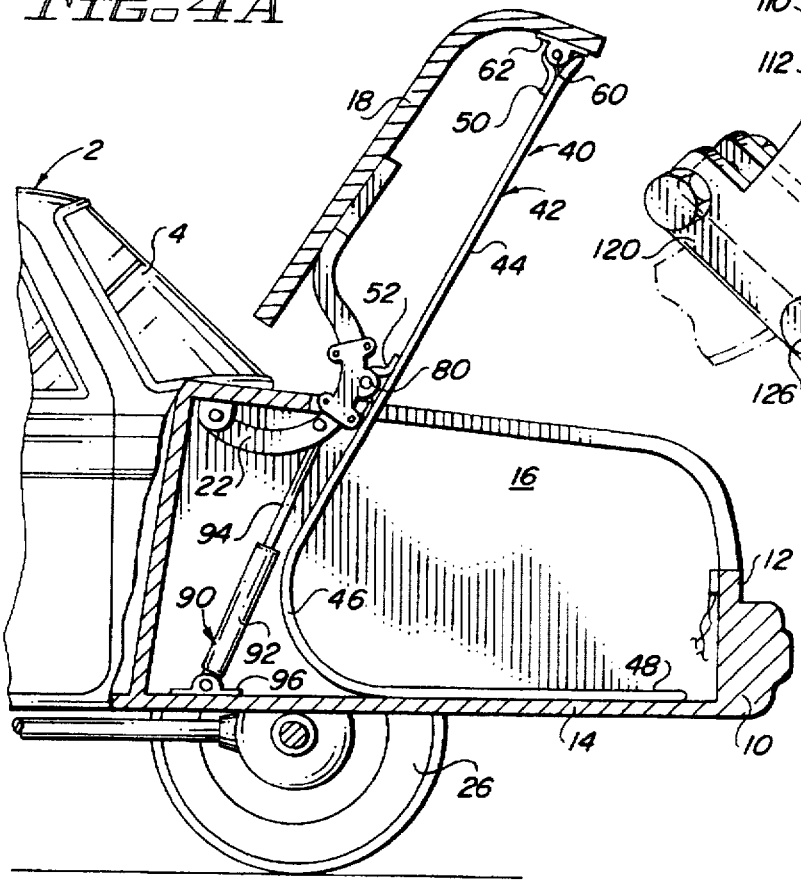
FIG. 4B
FIG. 5
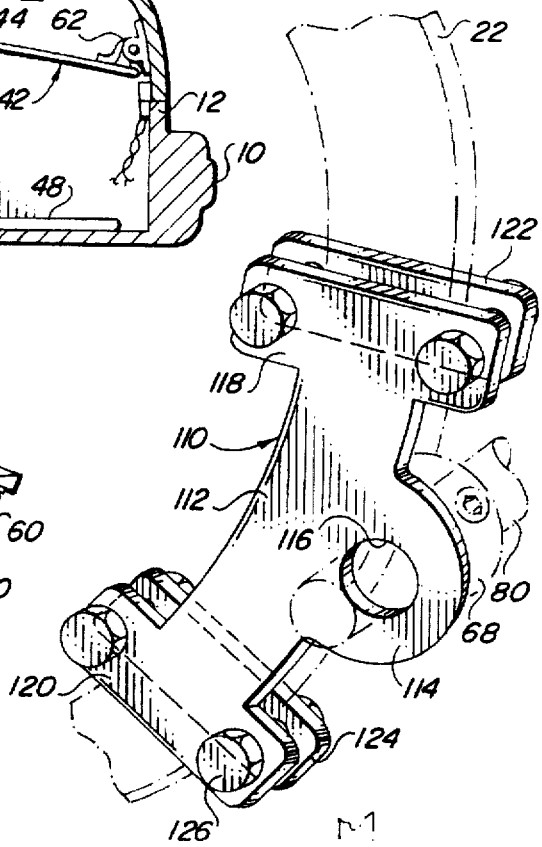
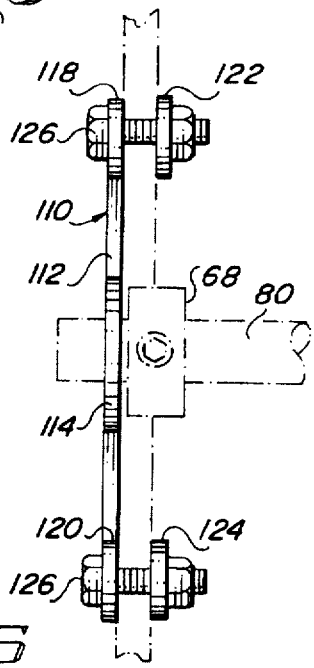
FIG. 6

192
208
210
154
158
156
158

140
8
60
9
190
142
144
160
192
9
8
146
222
214
80
10
10
218
148
230
208
220
206
202
200
204

142
158
164
154
168
156
170
166
162
160
144

216
214
210
212
208
202
200

160
162
178
176
174
180
164
158
156
154

154
142
158
150
60
156
152
80

TRUNK LID, BULLET RESISTANT APPARATUS

BACKGROUND OF THE INVENTION

1. Field of the Invention

This invention relates to bullet resistant apparatus for the trunk of a vehicle, and, more particularly, to bullet resistant apparatus secured to a trunk lid and which protects the rear portion of a vehicle when the trunk lid is open.

2. Description of the Prior Art

There are various types of bullet resistant apparatus for vehicles, such as disclosed in the applicant's own patents, namely:

U.S. Pat. No. 5,271,311, dated Dec. 21, 1993

U.S. Pat. No. 5,370,035, dated Dec. 6, 1994

U.S. Pat. No. 5,413,026, dated May 9, 1995

U.S. Pat. No. 5,438,908, dated Aug. 8, 1995

U.S. Pat. No. 5,487,323, dated Jan. 30, 1996

There are other patents which disclose various bullet resistant elements of vehicles, such as U.S. Pat. No. 3,855,898 (McDonald), and 3,923,339 (McDonald).

The differences between the applicant's concepts and those of McDonald are rather obvious. The apparatus of McDonald discloses generally a permanent installation, in which bulletproof or bullet resistant elements are permanently affixed to the vehicle. The patents of applicant, the bullet resistant elements are portable, and may thus be easily and quickly removed from a vehicle, stored in a vehicle's trunk, or transferred from one vehicle to another, with minimum time and effort required for the installation and removal of the elements of the various apparatus.

The apparatus of the present invention protects the rear portion of a vehicle by securing bullet resistant elements to the inside of a trunk lid, and the bullet resistant elements are deployed when the trunk lid is open. The elements may be rather easily installed and removed and converted to a portable shield.

SUMMARY OF THE INVENTION

The invention described and claimed herein comprises bullet resistant elements including a plurality of layers of bullet resistant cloth material, and the upper portion of the cloth material is secured to the inside of a trunk lid and extends downwardly therefrom. The bullet resistant apparatus is deployed to protect the rear portion of a vehicle when the trunk lid is open. The trunk lid may be opened from inside the vehicle or the trunk lid may be opened from the outside of the vehicle to deploy the apparatus. The trunk lid is moved upwardly from its down position, and is held in the open position by a pair of gas actuated struts, well known in the art, or the trunk lid may be moved by a motor or the like.

Among the objects of the present invention are the following:

To provide new and useful bullet resistant apparatus for a vehicle;

To provide new and useful bullet resistant apparatus for protecting the rear of a vehicle, including the rear window of the vehicle;

To provide new and useful bullet resistant apparatus secured to the trunk lid of a vehicle;

To provide new and useful bullet resistant apparatus for a vehicle including bullet resistant elements deployed when the trunk lid is open;

To provide new and useful bullet resistant apparatus disposed in a vehicle trunk and deployed by the opening of the trunk lid of the vehicle; and To provide new and useful bullet resistant apparatus for protecting the rear of a vehicle and removable from the vehicle to protect an individual disposed behind the apparatus.

BRIEF DESCRIPTION OF THE DRAWING

FIG. 4A is a side view in partial section of the apparatus of the present invention in its storage position.

FIG. 4B is a side view in partial section sequentially following FIG. 4A illustrating the apparatus of the present invention in its deployed position.

FIG. 5 is a perspective view of a portion of the apparatus of the present invention.

FIG. 6 is a front view of the apparatus of FIG. 5.

DESCRIPTION OF THE PREFERRED EMBODIMENT

Figure 1:
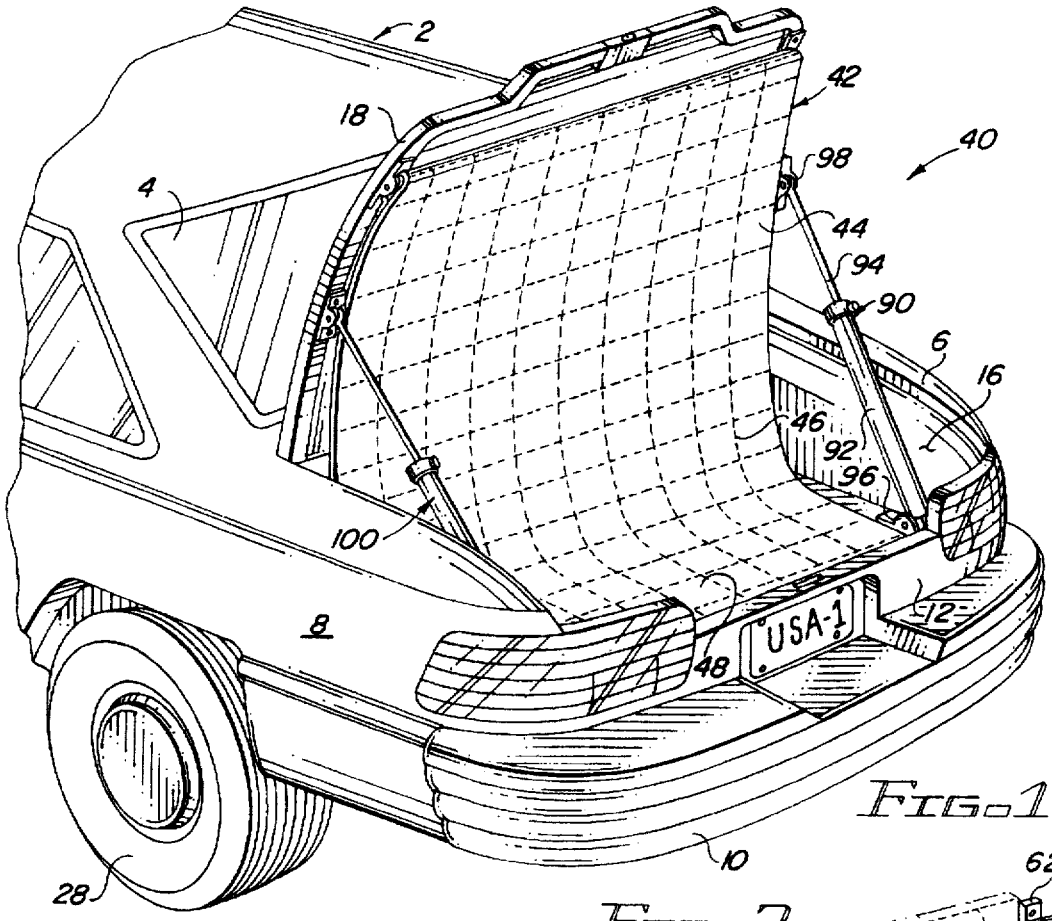
FIG. 1 is a perspective view of the apparatus of the present invention deployed in its use environment.

FIG. 1 is a perspective view of the rear portion of a vehicle 2 showing bullet resistant trunk apparatus 40 secured to the vehicle. The vehicle 2 includes a rear window 4, a right rear quarter panel 6, a left rear quarter panel 8, and a rear bumper 10. Above the rear bumper 10 is a vertical panel 12. The vertical panel 12 extends between the quarter panels 6 and 8.

FIGS. 4A and 4B comprise sequential side views in partial section of the rear portion of the vehicle 2 illustrating the apparatus 40 in the folded or stored position and the open or deployed position. For the following discussion, reference will be made primarily to FIGS. 1, 4A, and 4B.

Figure 3:
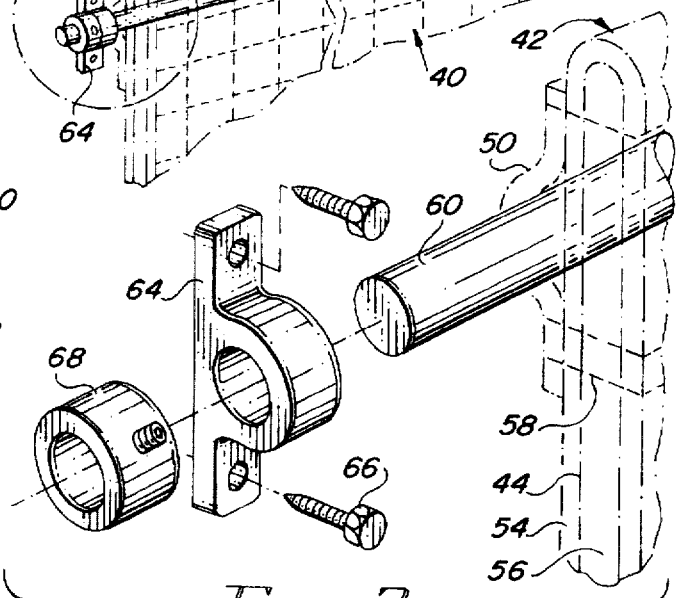
FIG. 3 is an enlarged and exploded view taken generally from circle 3 of FIG. 2.

Within the vertical panel 12, and between the quarter panel 6 and 8, is a trunk space 16. The bottom of the trunk space 16 comprises a trunk floor 14. A trunk lid 18 is shown in the up, or open, position. As is well known and understood, the trunk lid 18 pivots on a pair of hinges. A hinge 22 for the trunk lid 18 is shown in FIGS. 3 and 4.

To help overcome the weight of the bullet resistant trunk apparatus 40, struts 90 and 100 are secured to both the trunk lid 18 and the floor 14. The struts 90 and 100, also well known and understood in the art, comprise either gas loaded or spring loaded elements which help to open the trunk lid 18 when the trunk is either opened manually or remotely, both of which opening concepts are also well known and understood in the art. Two different orientations of the struts are illustrated as alternatives. In FIG. 1, the struts are secured to the rear of the floor 14, and in FIGS. 4A and 4B the strut 90 is shown secured to the front portion of the floor 14.

Two rear wheels 26 and 28 are shown, with only the right rear wheel 26 shown in FIGS. 4A and 4B and only the left wheel 28 shown in FIG. 1.

FIG. 4A shows the a trunk lid 18 in its down, locked position, with the bullet resistant trunk apparatus 40 folded, and FIG. 4B is a similar view in partial section showing the trunk lid 18 open, with the bullet resistant trunk apparatus 40 in its open, deployed, position.

The bullet resistant trunk lid apparatus 40 includes a bullet resistant curtain 42 having an upper portion 44, a lower portion 46, and a mat portion 48. The flexibility of the curtain 42 allows the two portions 44 and 46 to fold somewhat for storage purposes, such as illustrated in FIG. 4A. The curtain 42 includes a plurality of layers of polyethylene or aramid bullet resistant ballistic material, such as "Spectra" material or "Kevlar" material, or other appropriate material. Both the "Spectra" and the "Kevlar" material are cloth elements, relatively well known in the industry, and are discussed in detail in the above disclosed patents of the inventor hereof.

For convenience in construction, installation, etc., the layers of ballistic material in the curtain 42 are appropriately stitched together and disposed within a covering of appropriate material, such as ballistic nylon. This will be discussed below.

Disposed on the trunk floor 14 is the mat portion 48. The portion 48 comprises a mat which is essentially the bottom of the lower portion.46. The mat 48 is a lower or anchor portion of the curtain apparatus 40 for purposes of helping to hold the curtain apparatus in place.

While the curtain 42 is an integral element, it may be conveniently divided into three portions for discussion purposes, the upper portion 44, the lower portion 46, and the mat portion 48, as discussed above. The mat portion 48 is generally horizontally disposed on the floor 14 of the trunk, a rod 80 extends transversely across the trunk lid generally parallel to the rod 60. The portion of the curtain 42 above the rod 80 may be considered as the upper portion 44, and the portion below the rod 80 may be considered as the lower portion 46. The three portions may best be understood from FIGS. 4A and 4B. The rod 80 is appropriately secured to the trunk lid hinges of the vehicle 2. The rod 80 acts as a pivot rod for the bullet resistant curtain 42. The rod 80 also supports the curtain when the trunk lid 18 is in the down position, as shown in FIG. 4A. Moreover, the rod 80 also helps to hold the curtain 40 in position while the vehicle is moving. The rod 80 extends through a sleeve on the rear of the curtain 40 and essentially divides the curtain 42 into the two portions 44 and 46.

Figure 2:
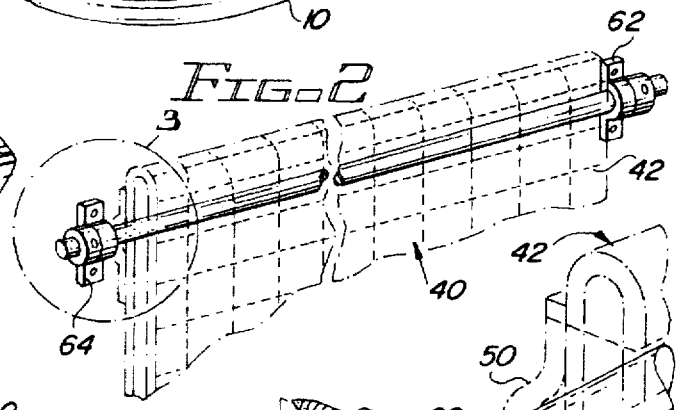
FIG. 2 is an enlarged perspective view of a portion of the apparatus of FIG. 1.

FIGS. 2 and 3 illustrate how the upper portion 44 is secured to the trunk 18. FIG. 2 is a perspective view illustrating the elements securing a rod 60 to the trunk lid 18 by a pair of brackets 62 and 64. FIG. 3 is an enlarged and exploded view of the rod 60 and associated elements showing the brackets 64 and the rod 60. The brackets 62 and 64 are secured to structural elements on the underneath or bottom portion of the trunk lid 18, as may be understood from FIGS. 1, 4A, and 4B.

The brackets 62 and 64 are appropriately secured to structural elements of the trunk lid 18 by appropriate fasteners, such as sheet metal screws 66. Lock collars 68 may be used to secure the rod 60 to the bracket 62 and 64. The lock collars 68 are in turn secured in place by well known elements, such as set screws, or the like.

The brackets 62 and 64 are substantially identical to each other, and may be made of appropriate material, such as steel, aluminum, or the like. Similarly, the rod 60 may be made of appropriate material, such as steel, or the like. The rod 60 may be a tubular element, if desired, or it may be a solid element, as shown.

The rod 60 extends through a sleeve 50 on the upper portion of the "rear" portion of the curtain 42. The curtain 42 is illustrated as including a plurality of layers of bullet resistant material 56 within a cover 54. The sleeve 50 is secured to the material 56 and the cover 54 by appropriate stitching 58.

Returning again to FIGS. 4A and 4B, there is the second rod 80 that extends between the hinges of the vehicle 2. The purpose of the rod 80 is to help support the curtain apparatus 40 and to hold the curtain in place when the curtain is folded, as shown in FIG. 4A, as discussed above. The rod 80 is secured to the hinges of the lid 18 by brackets illustrated in FIGS. 5 and 6.

FIG. 5 comprises a perspective view showing a bracket assembly 110 secured to a hinge 22. FIG. 6 is an end view of the bracket assembly 110. For the following discussion, reference will primarily be made to FIGS. 5 and 6.

The bracket assembly 110 includes a curved plate 112 which generally follows the contour or curve of the hinge 22. Extending outwardly from the plate 112 is an ear or tab 114. An aperture 116 extends through the ear 114 to receive an end of the rod 80. A collar 68 is secured to the rod 80 to hold the rod 80 in place relative to the bracket assembly 110.

A top arm 118 and a bottom arm 120 extend outwardly from the plate 112. Fasteners 126 are used to secure a top plate 122 and a bottom plate 124 to the arms 118 and 120, respectively. The arms and their plates are appropriately aperture to receive the fasteners 126. The plates 122 and 124 are on the opposite side of the hinge 22 to secure the plate 122, and the rod 80, or rather one end of the rod 80, to the hinge 22.

A pair of bracket assemblies 110 are used to secure the rod to the trunk hinges, as may be understood. Only one bracket assembly 110, and one hinge 22, are illustrated.

As best shown in FIGS. 1 and 4B, the strut 90 includes two portions, a lower cylinder portion 92 and an upper rod portion 94. The rod portion 94 is essentially a piston rod movable in response to gas or spring pressure within the cylinder 92.

The cylinder 92 is pivotally secured to a bracket 96, and the bracket 96 is in turn secured to the trunk floor 14 by appropriate fasteners, such as sheet metal screws. Similarly, the outer end of the rod 94 is secured to the trunk lid or to a trunk hinge by a similar bracket.

In FIGS. 4A and 4B, the strut 90 is shown extending between the hinge 22 and the trunk floor 14. The rod 94 is secured to the hinge 22 while the cylinder 92 is secured to the trunk floor 14 forwardly of the mat portion 48.

Figures 7, 8, 9, 9A, 10, 11:
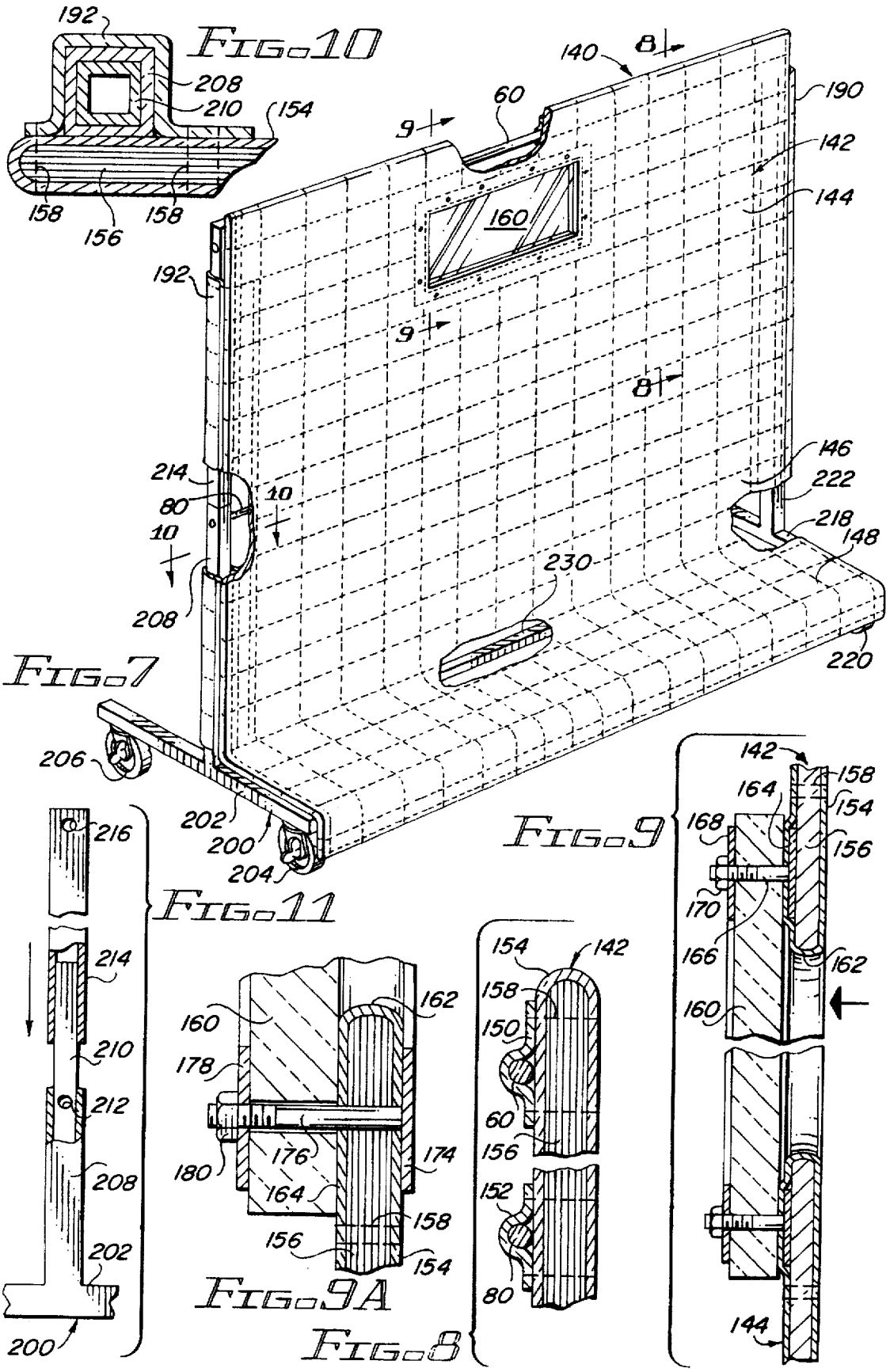
FIG. 7 is a perspective view of an alternate embodiment of the apparatus of the present invention.
FIG. 8 is a view in partial section taken generally along line 8—8 of FIG. 7.
FIG. 9 is a view in partial section taken generally along line 9—9 of FIG. 7.
FIG. 9A is a view in partial section illustrating an alternate embodiment of the apparatus of FIG. 9.
FIG. 10 is a view in partial section taken generally along line 10—10 of FIG. 7.
FIG. 11 is a schematic representation of a portion of the apparatus of FIG. 7.

An alternate embodiment of the curtain apparatus 40 is shown in FIGS. 7, 8, 9, 9A, 10, and 11. FIG. 7 comprises a perspective view of curtain apparatus 140, and FIG. 8 comprises a side view in partial section of the apparatus 120 taken generally along line 8—8 of FIG. 7. FIGS. 9 and 10 are also enlarged views in partial section and taken generally along lines 9—9 and 10—10, respectively, of FIG. 7. For the following discussion, reference will primarily be directed to FIGS. 7, 8, 9, and 10.

The apparatus 140 includes a bullet resistant curtain 142 which includes an upper portion 144 and a lower portion 146. A mat portion 148 extends generally horizontally from the lower portion 146. In addition to horizontal sleeves for rods 60 and 80 (not shown), are vertical side sleeves 190 and 192. The sleeves 190 and 192 receive posts for securing the curtain 142 to a movable support base 200. The base 200 converts the curtain 142 into a movable protective shield behind which an officer may move, as required, with some degree of safety.

The base 200 includes a horizontal member 202 to which are secured wheels 204 and 206. Extending upwardly from the member 202 is a vertical lower post 208. As shown in FIG. 11, which comprises a side view of a portion of the member 202 and its associated elements, an insert 210 extends upwardly from the lower post 208. An upper post 214 is disposed on the insert 210 and rests on the top of the post 208.

An aperture 212 extends through the upper portion of the post 208 and the insert 210 to receive an end of the rod 80 (not shown), and an aperture 216 extends through the post 214 to receive an end of the rod 80.

A transverse horizontal member 230 (see FIG. 7) extends between the member 202 and a parallel member 218 at the opposite end of the curtain 140. A lower post 222 is shown extending upwardly from the member 218. The lower post 222 and its insert and upper post (not shown) extend into the sleeve 190. The opposite ends of the rods 60 and 80 extend into the post 222 and its associated elements, substantially as shown for the lower post 208, the insert 210, and the upper post 214.

A pair of wheels is secured is secured to the member 218. A portion of one of the wheels, a wheel 220, is shown in FIG. 7.

The construction of the curtain 142 is substantially identical to the curtain 40, except for the sleeves 190 and 192 and a window 160. That is, the curtain 142 is made of a plurality of layers of appropriate bullet resistant material, such as "Kevlar" or "Spectra" or other, as discussed above.

The window 160 is shown in FIG. 7, and details of the window 160 are shown in FIG. 9. FIG. 9 comprises a view in partial section through the window 160 and the adjacent portions of the upper curtain portion 144.

There is an aperture 162 through the curtain portion 144, and the window 160 is secured to the curtain portion 144 about the aperture 162. The window 160 comprises a transparent bullet resistant insert covering the opening or aperture 162 through which an officer may view the area in front of the apparatus 140 when the apparatus is employed as a movable shield.

The window 160 is secured to the curtain portion 144 by means of a rectangular frame 164 and a plurality of studs 166 which extend from the frame and through the window 160. The studs 166 extend through a second rectangular frame 168 and nuts 170 are used to secure the two frames 164 and the window 160 to the curtain 142.

The inner frame 164 is disposed within the outer cover 154 and is secured therein by stitching 158.

A large arrow in FIG. 9 shows the direction of a bullet relative to the window 160.

FIG. 9A discloses an alternate structure for securing the window 160 to the curtain portion 144. A frame 174 is disposed on the front side of the curtain 142 about the aperture 162, and studs 176 extend from the frame 174 through the curtain portion 144 and through the window 160. The studs 176, which are, of course, appropriately secured to the frame 174, as by welding, then extend through a mating frame 178. Nuts 180 are then used to secure the window 160 to the two frames 174 and 178 and thus to the portion 144 of the curtain 142.

At the top of the upper curtain portion 144 the rod 60 and a pair of brackets is used to secure the rod 60 to a trunk lid as described above. The rod 80 is similarly secured to the trunk hinges, and the curtain 142 is thus secured to the trunk. The rods 60 and 80 are easily removed from the trunk and secured to the base 200, along with the curtain 142, to provide a movable shield.

In operation, the base 200, with its posts, are disposed within the vehicle trunk. As indicated above, the curtain 142 is secured to the trunk and is deployed or opened when the trunk is opened, just as is the curtain 42 of the apparatus 40. However, the apparatus 140 includes the ability to be removed from the vehicle and then be secured to the support bracket 200 to act as a shield behind which an officer may be disposed.

Figure 12:
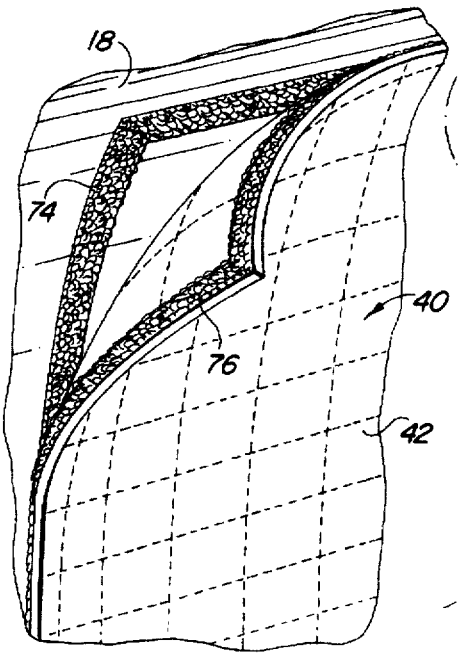
FIG. 12 is a perspective view of an alternate embodiment of the apparatus of the present invention.

FIG. 12 comprises a perspective view of an alternate embodiment of the curtain apparatus 40 in which hook and loop fasteners are used to secure the bullet resistant curtain 42 to the trunk lid 18.

Hook and loop fasteners 74 and 76 are secured respectively to the trunk lid 18 and to the curtain 42. The mating of the hook and loop fasteners effectively secures the curtain 42 to the trunk lid 18. This type of fasteners obviates the use of the rods 60 and 80 and the associated brackets.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Bullet resistant apparatus for a vehicle having a trunk opening, a lid pivotally secured to the vehicle and covering the trunk opening, and a trunk floor, comprising in combination:

bullet resistant means secured to the trunk lid and hanging downwardly therefrom when the trunk lid is open and including a lower portion disposed on the trunk floor for protecting the rear of the vehicle from ballistic elements fired from rearwardly of the vehicle; and means for opening the trunk to deploy the bullet resistant means.

2. The apparatus of claim 1 in which the means for opening the trunk includes a strut secured to the vehicle body and to the trunk lid.

3. The apparatus of claim 1 in which the bullet resistant means includes a bullet resistant curtain.

4. The apparatus of claim 3 in which the bullet resistant means further includes a first rod secured to the trunk lid, and the bullet resistant curtain is secured to the first rod.

5. The apparatus of claim 4 in which the first rod is removably secured to the trunk lid for removing the bullet resistant curtain from the vehicle.

6. The apparatus of claim 5 in which the bullet resistant means further includes first and second bracket means secured to the trunk lid for supporting the first rod in the vehicle trunk.

7. The apparatus of claim 4 in which the bullet resistant means further includes a second rod to which the bullet resistant curtain is secured.

8. The apparatus of claim 7 in which the bullet resistant means further includes a pair of brackets secured to the trunk lid for supporting the second rod.

9. The apparatus of claim 1 in which the bullet resistant means comprises a bullet resistant curtain removably secured to the trunk lid.

10. The apparatus of claim 9 which further includes support base means to which the bullet resistant curtain may be secured when the curtain is removed from the trunk lid.

11. The apparatus of claim 10 in which the bullet resistant means further includes a bullet resistant window in the curtain for viewing when the curtain is secured to the support base means.

12. The apparatus of claim 10 in which the support base means includes a pair of posts, and the bullet resistant means further includes sleeves secured to the bullet resistant curtain for receiving the posts to secure the bullet resistant means to the support base means.

13. The apparatus of claim 12 in which the bullet resistant means further includes a first rod for securing the curtain to the trunk lid and to the posts of the support base means.

14. The apparatus of claim 13 in which the support base means further includes wheels for moving the support base means and the curtain to define a movable shield.

15. The apparatus of claim 14 in which the bullet resistant means further includes a transparent bullet resistant insert in the curtain for viewing through the curtain.

* * * * *